US006785500B2

(12) United States Patent
Takahashi et al.

(10) Patent No.: US 6,785,500 B2
(45) Date of Patent: Aug. 31, 2004

(54) IMAGE FORMING APPARATUS INCLUDING IMAGE TRANSFER BODY WITH ELASTIC LAYER AND COATING LAYER

(75) Inventors: Mitsuru Takahashi, Kawasaki (JP); Yuuji Sawai, Yokohama (JP); Hiromi Ogiyama, Tokyo (JP); Katsuya Kawagoe, Tokyo (JP); Akihiro Sugino, Numazu (JP); Kohki Katoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/193,219

(22) Filed: Jul. 12, 2002

(65) Prior Publication Data

US 2003/0016968 A1 Jan. 23, 2003

(30) Foreign Application Priority Data

Jul. 13, 2001 (JP) ..... 2001-213178

(51) Int. Cl.[7] ..... G03G 15/16
(52) U.S. Cl. ..... 399/297; 399/3.2; 399/308
(58) Field of Search ..... 399/101, 299, 399/302, 308, 297; 430/108.8

(56) References Cited

U.S. PATENT DOCUMENTS

| | | | | |
|---|---|---|---|---|
| 5,483,330 A | | 1/1996 | Ogiyama et al. | |
| 5,870,650 A | | 2/1999 | Takahashi et al. | |
| 5,890,030 A | | 3/1999 | Namekata et al. | |
| 5,978,639 A | | 11/1999 | Masuda et al. | |
| 6,009,297 A | | 12/1999 | Maeda et al. | |
| 6,035,157 A | | 3/2000 | Takahashi et al. | |
| 6,163,661 A | | 12/2000 | Namekata et al. | |
| 6,180,298 B1 | * | 1/2001 | Kuroda et al. | 430/108.8 |
| 6,212,351 B1 | | 4/2001 | Kawagoe et al. | |
| 6,385,409 B2 | * | 5/2002 | Suzuki et al. | 399/302 |
| 6,445,900 B2 | | 9/2002 | Motohashi et al. | |
| 6,449,453 B1 | | 9/2002 | Fukao et al. | |

FOREIGN PATENT DOCUMENTS

| | | | |
|---|---|---|---|
| EP | 1 014 218 A2 | | 6/2000 |
| JP | 1-140174 | | 6/1989 |
| JP | 10-31374 | | 2/1998 |
| JP | 11-149177 | | 6/1999 |
| JP | 2000-10333 | | 1/2000 |
| JP | 2000-10416 | | 1/2000 |
| JP | 2000-155511 | | 6/2000 |
| JP | 2000-310912 | | 11/2000 |
| JP | 2001-166659 A | * | 6/2001 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus of the present invention includes a cleaning device for cleaning an intermediate image transfer body. A cleaning blade included in the image transfer body is formed of fluorocarbon resin or a thin layer of fluorocarbon resin is formed on the surface of the intermediate image transfer body. Further, wax is coated on the intermediate image transfer body or wax or lubricant powder is contained in toner. A moving mechanism holds the cleaning blade spaced from the intermediate image transfer body at least when image formation is not under way.

12 Claims, 4 Drawing Sheets

IMAGE FORMING APPARATUS INCLUDING IMAGE TRANSFER BODY WITH ELASTIC LAYER AND COATING LAYER

BACKGROUND OF THE INVENTION

1. Field of the Invention

The present invention relates to a copier, printer, facsimile apparatus or similar electrophotographic image forming apparatus and more particularly to an electrophotographic image forming apparatus of the type including an intermediate image transfer body.

2. Description of the Background Art

Today, a tandem, image forming apparatus including a plurality of photoconductive elements is spreading because of its high-speed color image forming ability. A direct image transfer system and an indirect image transfer system are available with a tandem, image forming apparatus. A direct image transfer system sequentially transfers toner images of different colors formed on the photoconductive elements to a sheet one above the other. An indirect image transfer system transfers the toner images of different colors to an intermediate image transfer body one above the other and then transfers the resulting full-color image from the intermediate image transfer body to a sheet.

The problem with the direct image transfer system is that the photoconductive elements, a sheet feeding device and a fixing device must be arranged in parallel, increasing the overall size of the image forming apparatus in the direction of sheet conveyance. While nearby devices may be arranged at as short a distance as possible from each other to solve the above problem, such an arrangement makes it impossible to implement a margin great enough for a sheet to deform. As a result, the fixing device is apt to effect image formation performed at the upstream side due to an impact ascribable to the leading edge of a sheet entering the fixing device or a difference in speed between the sheet being conveyed through the fixing device and the sheet conveying speed of a conveyor.

By contrast, the indirect image transfer system allows various devices to be relatively freely laid out and can therefore implement a margin great enough for a sheet to deform. This successfully obviates the influence of the image transfer system on image formation and reduces the overall size of the apparatus. For these reasons, a tandem, image forming apparatus using the indirect image transfer system is attracting attention.

The indirect image transfer system, however, has the following problems left unsolved. Up to four toner layers stacked together on the intermediate image transfer body are collectively transferred to a sheet, so that a great amount of toner remains on the transfer body. This, coupled with the fact that the image transfer body is intensely charged to positive polarity or negative polarity, makes it difficult to clean the transfer body.

To cope with sheets having irregular surfaces, among others, the intermediate image transfer body may include an elastic layer, as proposed in the past. However, the elastic layer has great frictional resistance and therefore makes it more difficult to clean the intermediate image transfer body.

For example, a cleaning blade, which is a specific form of cleaning means, is apt to leave pressure marks on the elastic layer. If the cleaning blade is formed of an elastic material, then it is likely that the cleaning blade is rolled up, rolled in or otherwise deformed.

In light of the above, it has been customary to clean the intermediate image transfer body with a bias cleaning method using, e.g., a bias roller. The bias cleaning method, however, needs a sophisticated configuration and cannot exhibit a sufficient cleaning ability.

Technologies relating to the present invention are disclosed in, e.g., Japanese Patent Laid-Open Publication Nos. 2000-10333, 2000-10416, 2000-155511 and 2000-310912.

SUMMARY OF THE INVENTION

It is an object of the present invention to provide an image forming apparatus capable of effectively cleaning an intermediate image transfer body, which includes an elastic layer, with a simple configuration.

An image forming apparatus of the present invention includes a cleaning device for cleaning an intermediate image transfer body. A cleaning blade included in the image transfer body is formed of fluorocarbon resin or a thin layer of fluorocarbon resin is formed on the surface of the intermediate image transfer body. Further, wax is coated on the intermediate image transfer body or wax or lubricant powder is contained in toner. A moving mechanism holds the cleaning blade spaced from the intermediate image transfer body at least when image formation is not under way.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
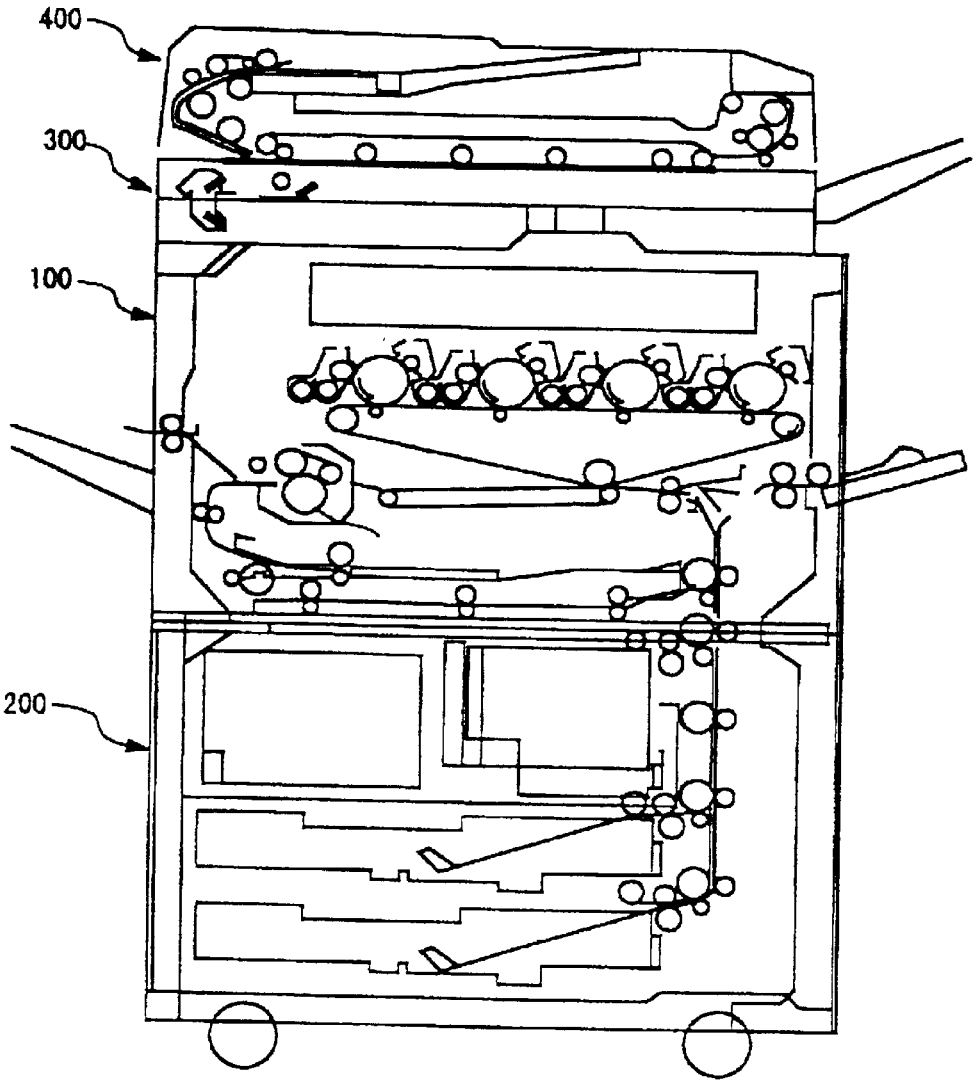
FIG. 1 is a view showing an image forming apparatus embodying the present invention.

Referring to FIG. 1 of the drawings, an image forming apparatus embodying the present invention is shown. As shown, the image forming apparatus includes an ADF (Automatic Document Feeder) 400. A scanner 300 reads a document fed from the ADF 400 while sending image data representative of the document to an image forming section 100. At the same time, a sheet feeding device 200 feeds a sheet or recording medium to the image forming section 100. The image forming section 100 forms a toner image on the sheet in accordance with the image data on the sheet.

After the toner image has been fixed on the sheet, the sheet or print is driven out of the image forming apparatus.

Figure 2:
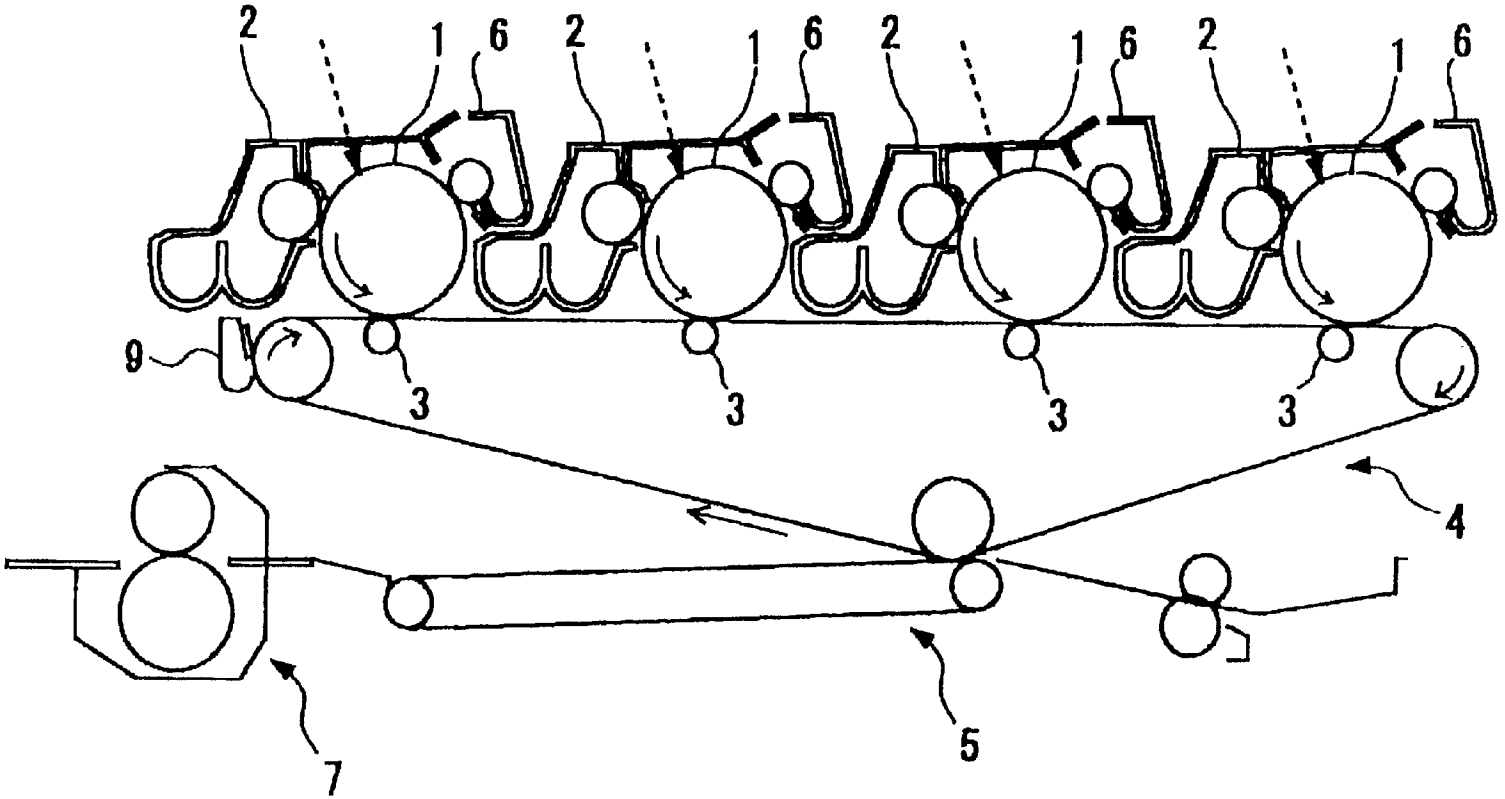
FIG. 2 is a view showing essential part of an image forming section included in the illustrative embodiment.

More specifically, as shown in FIG. 2, the image forming section 100 includes a plurality of photoconductive elements implemented as drums 1 and each being assigned to a particular color. Color-by-color latent images each are formed on one of the drums 1 and then developed by a developing device 2 to become a toner image. The toner images of different colors so formed on the drums 1 are sequentially transferred to an intermediate image transfer body 4 one above the other by primary image transferring devices 3, completing a full-color image. In the illustrative embodiment, the image transfer body 4 is implemented as a belt and will be referred to as a belt 4 hereinafter. The full-color image is transferred from the belt 4 to a sheet by a secondary image transferring device 5 and then fixed by a fixing device 7. A cleaning device 9 assigned to the belt 4 adjoins one of rollers over which the belt 4 is passed. After the second image transfer, the cleaning device 9 cleans the surface of the belt 4.

Figure 3:
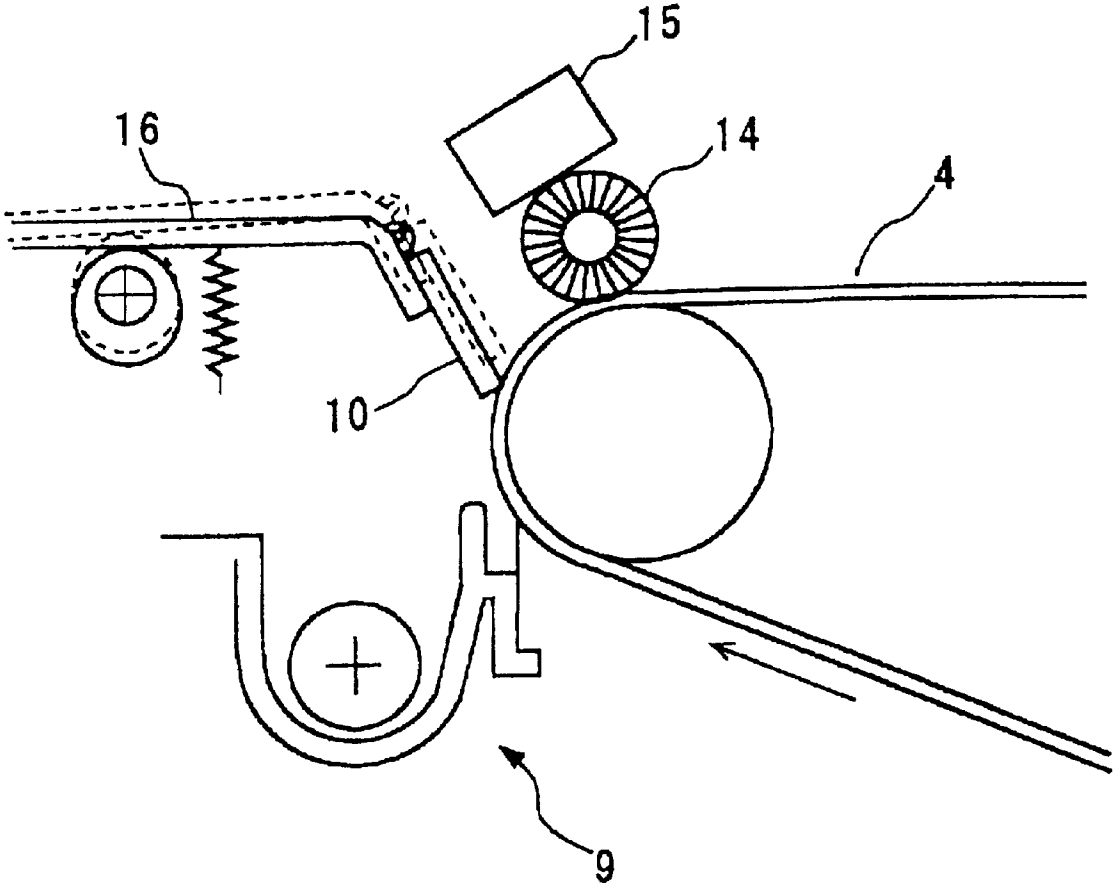
FIG. 3 is a fragmentary view showing a cleaning device for cleaning an intermediate image transfer body included in the illustrative embodiment.

FIG. 3 shows a specific configuration of the cleaning device 9. As shown, the cleaning device 9 includes a cleaning blade 10 configured to scrape off tone left on the belt 4 after the secondary image transfer. When the cleaning blade 10 is formed of fluorocarbon resin, the frictional resistance of the blade 10 decreases. Therefore, even if the surface of the belt 4 is implemented as an elastic layer, the cleaning blade 10 is prevented from being rolled up, rolled in or otherwise deformed by the belt 4 and can desirably clean the belt 4.

Figure 4:
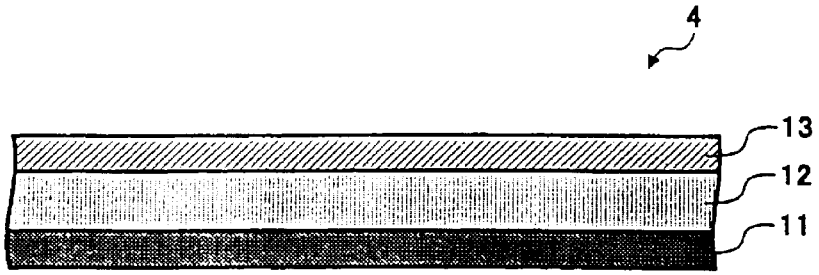
FIG. 4 is a section showing a belt used as the intermediate image transfer body.

As shown in a section in FIG. 4, although the belt 4 includes an elastic layer 12, the surface of the elastic layer 12 is coated with fluorocarbon resin to form a surface layer 13. The surface layer 13 reduces the frictional resistance of the belt 4 and can therefore be desirably cleaned. It follows that the cleaning blade 10, FIG. 3, is not rolled up, rolled in or otherwise deformed even if it is formed of urethane rubber or similar rubber.

However, fluorocarbon is not elastic. Therefore, to allow the elastic layer 12 of the belt 4 to exhibit its effect, the surface layer 13 formed of fluorocarbon should preferably be as thin as 2 $\mu$m or less. The elastic layer 12 inclusive of the surface layer 13 should preferably be have hardness of 80° or less in JIS (Japanese Industrial Standards) A scale. The overall thickness of the belt 4 should preferably be between 0.2 mm and 0.5 mm. Fluorocarbon may be polyvinylidene fluoride or tetraethylene fluoride by way of example.

Referring again to FIG. 3, a coating brush or coating means 14 for coating a lubricant on the belt 4 is positioned downstream of the cleaning device 9 in the direction of movement of the belt 4. The coating brush 14 shaves off a solid lubricant 15 little by little and uniformly coats in on the surface of the belt 4. The lubricant makes it difficult for toner to remain on the belt 4 and thereby allows the cleaning blade 10 to more easily clean the surface of the belt 4. For the lubricant 15, use may be made of zinc stearate or similar common lubricant.

Alternatively, wax or lubricant powder may be contained in toner in order to promote the parting of toner from the belt 4. This is also successful to reduce frictional resistance between the cleaning blade 10 and the belt 4.

The belt 4 can adapt itself to a sheet with an irregular surface more easily as the surface hardness of the elastic layer 12 becomes lower and the elastic layer 12 becomes thicker. However, in the case where the edge of the cleaning blade 10 is constantly held in contact with the belt 4, the cleaning blade 10 leaves a bite mark in the elastic layer 12 when the apparatus is left unused over a long time, resulting in a white horizontal stripe in an image. Moreover, in such a configuration, it is likely that the cleaning blade 10 is rolled in when the apparatus starts operating after a long suspension.

Figure 5:
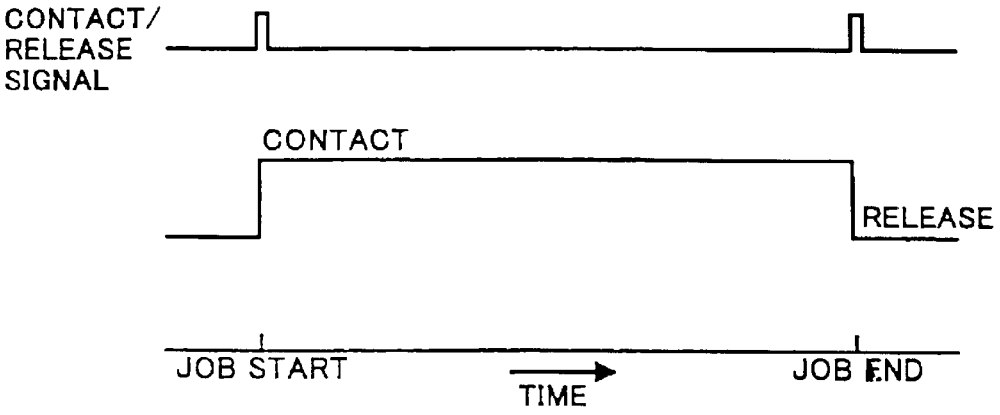
FIG. 5 is a timing chart demonstrating a specific operation of a moving mechanism included in the cleaning device.

In light of the above, in the illustrative embodiment, the cleaning device 9 additionally includes a moving mechanism 16 including, e.g., a half-rotation clutch and a cam. The moving mechanism 16 brings the cleaning blade 10 into contact with the belt 4 at the beginning of the operation of the apparatus, but releases the former from the latter at the end of the operation. FIG. 5 is a timing chart demonstrating a specific operation of the moving mechanism 16. With the moving mechanism 16, it is possible to protect the elastic layer 12 of the belt 4 from a bite mark ascribable to the cleaning blade 10 and to prevent the cleaning blade 10 from being rolled in.

While the illustrative embodiment has concentrated on an intermediate image transfer body implemented as a belt, the present invention is, of course, practicable with a roller-like intermediate image transfer body.

In summary, in accordance with the present invention, a cleaning device assigned to an intermediate image transfer body includes a cleaning blade formed of fluorocarbon resin. Alternatively, the surface of an intermediate image transfer body including an elastic layer is implemented as a thin coating layer of fluorocarbon resin. Such a configuration allows the intermediate image transfer body to be desirably cleaned.

Moreover, a lubricant is coated on the intermediate image transfer body or was or lubricant powder is contained in toner, further promoting the desirable cleaning of the intermediate image transfer body. In addition, a moving mechanism included in the cleaning device holds the cleaning blade spaced from the intermediate image transfer body at least when image forming is not under way. This protects the intermediate image transfer body from a pressure mark ascribable to the cleaning blade and prevents the cleaning blade from being rolled in.

Various modifications will become possible for those skilled in the art after receiving the teachings of the present disclosure without departing from the scope thereof.

What is claimed is:

1. An image forming apparatus comprising:

an intermediate image transfer body comprising an elastic layer;

at least two photoconductive elements held in contact with said intermediate image transfer body;

means for cleaning said intermediate image transfer body; and means for moving the means for cleaning into and out of contact with the intermediate image transfer body;

wherein a coating layer is disposed on a surface of said intermediate image transfer body and comprises an inelastic material having a coefficient of friction less than a coefficient of friction of said elastic layer.

2. The apparatus as claimed in claim 1, wherein said coating layer comprises a thin surface layer formed of fluorocarbon resin.

3. The apparatus as claimed in claim 2, wherein said surface layer is 2 $\mu$m thick or less while said elastic layer has a hardness of 80° or less in JIS (Japanese Industrial Standards) A scale.

4. The apparatus as claimed in claim 3, wherein said intermediate image transfer body comprises a belt.

5. The apparatus as claimed in claim 4, wherein the belt has a thickness between 0.2 mm and 0.5 mm.

6. The apparatus as claimed in claim 1, wherein said means for cleaning comprises a cleaning blade having a portion configured to contact said intermediate image transfer body formed of fluorocarbon resin.

7. The apparatus as claimed in claim 1, wherein said intermediate image transfer body comprises a belt movably passed over a plurality of rollers.

8. The apparatus as claimed in claim 1, further comprising: means for coating a lubricant on said intermediate image transfer body.

9. The apparatus as claimed in claim 1, wherein the means for moving comprises a moving mechanism configured to selectively move said means for cleaning into and out of contact with said intermediate image transfer body.

10. The apparatus as claimed in claim 9, wherein said moving mechanism is configured to move said means for cleaning out of contact with said intermediate image transfer body when said apparatus is not performing an image forming operation.

11. An image forming apparatus, comprising:

a transfer body comprising an elastic layer and a coating layer having a coefficient of friction less than a coefficient of friction of the elastic layer;

two photoconductive drums contacting the transfer body;

a cleaning member adapted to clean the transfer body; and means for moving the cleaning member into and out of contact with the transfer body.

12. The image forming apparatus according to claim 11, wherein the coating layer comprises a fluorocarbon resin.

* * * * *